United States Patent [19]

Röck

[11] Patent Number: 4,601,522

[45] Date of Patent: Jul. 22, 1986

[54] PULL-OUT GUIDE ASSEMBLY FOR DRAWERS OR THE LIKE

[75] Inventor: Erich Röck, Höchst, Austria

[73] Assignee: Julius Blum Gesellschaft m.b.H., Höchst, Austria

[21] Appl. No.: 601,159

[22] Filed: Apr. 17, 1984

[30] Foreign Application Priority Data

May 3, 1983 [AT] Austria ..... 1614/83

[51] Int. Cl.[4] ..... A47B 88/14

[52] U.S. Cl. ..... 384/19; 312/332; 312/341 R; 384/23

[58] Field of Search ..... 308/3.6, 3.8; 312/330 R, 332, 334, 335, 341 R, 348, 350

[56] References Cited

U.S. PATENT DOCUMENTS

| | | | |
|---|---|---|---|
| 4,196,943 | 4/1980 | Röck et al. | 308/3.8 |
| 4,351,575 | 9/1982 | Röck et al. | 308/3.8 |
| 4,367,906 | 1/1983 | Röck | 308/3.8 X |

FOREIGN PATENT DOCUMENTS

| | | | |
|---|---|---|---|
| 2518647 | 11/1981 | Fed. Rep. of Germany . | |
| 3138204 | 6/1982 | Fed. Rep. of Germany | 312/350 |
| 1082340 | 6/1967 | United Kingdom . | |
| 2037573 | 7/1980 | United Kingdom . | |
| 2096450 | 10/1982 | United Kingdom . | |

*Primary Examiner*—Stuart S. Levy
*Assistant Examiner*—David Werner
*Attorney, Agent, or Firm*—Wenderoth, Lind & Ponack

[57] ABSTRACT

In a pull-out guide assembly for drawers there are arranged at each side of the drawer a supporting rail at the side of the body and a pull-out rail at the side of the drawer. A roller carrier with rollers is mounted between the rails at each side. The supporting rail on one side of the drawer is rigidly fastened to the furniture side wall, while the supporting rail on the other side is mounted resiliently. The rails laterally support the rollers. Thus, lateral clearance of the drawer is prevented.

6 Claims, 2 Drawing Figures

PULL-OUT GUIDE ASSEMBLY FOR DRAWERS OR THE LIKE

FIELD AND BACKGROUND OF THE INVENTION

The invention relates to a pull-out guide assembly for drawers or the like, comprising on each side a pull-out rail at the side of the drawer and a supporting rail at the side of the body, the load being transmitted from the pull-out rails to the supporting rails by means of slides or rollers, and the pull-out rails and the supporting rails having lateral guides track.

DESCRIPTION OF THE PRIOR ART

In the longest known pull-out guide assemblies, rollers or slides are mounted at the supporting and pull-out rails to transmit the load of the drawer from the pull-out rails to the supporting rails and to reduce the friction of parts moved relative to one another when the drawer is displaced.

According to the state of the art, two further kinds of pull-out guide assemblies are known in which the rollers are not directly fastened to one of the rails, but rather are arranged in separate roller carriers. The best known are the so-called ball roller pull-out guides in which the load is transmitted between the rails by means of steel balls which are held in a roller carrier designed as a roller cage.

Such pull-out guides are very precise, i.e. they ensure excellent running of the drawer and permit at the same time a good fit of the drawer in the body, i.e. the drawer is laterally as well as vertically guided in a very stable manner. Such pull-out guide assemblies are mounted, in particular, into high-quality furniture, e.g. office furniture.

The disadvantage of such pull-out guide assemblies is that the rails must have complicated profiles to define the rolling tracks for the balls. It is a further disadvantage that such pull-out guide assemblies provide no self-closing effect. Thus, a drawer which has not been completely closed is not automatically fully pulled into the furniture body but remains in a partially open position.

Another type of pull-out guide assembly has been on the market for a short time only and has cylindrical rollers, namely of the same kind as normally mounted directly at the rails. Such pull-out guide assemblies also have very good running properties and can easily be provided with automatic closing means. However, their stability, in particular the lateral stability, is not satisfactory. In the past, such pull-out guides have therefore been provided with lateral slides. This solution has never proved entirely satisfactory because it provides lateral alignment for the drawer in the inserted position only, but does not enhance the lateral stability of the drawer when the drawer is being pulled out.

SUMMARY OF THE INVENTION

It is the object of the invention to provide a pull-out guide assembly which has the advantage of ball guiding means with respect to lateral stability, as well as the advantages of a pull-out guide assembly with cylindrical rollers or slides, i.e. simple rail profiles, and that a draw-in effect for a not fully closed drawer can easily be achieved. It is an essential advantage of pull-out guide assemblies with rollers that the rollers may be of plastic which permits coating of the rails. Steel balls would damage such coating.

According to the invention this is achieved in that one of the supporting rails at one side of the drawer is fixed to the furniture body, while the other supporting rail at the other side of the drawer is laterally movably fastenend to the furniture body, preferably in a resilient manner, for example by means of flaps punched out of the fastening flange of the supporting rail.

Hence, it is possible to make the pull-out guide assembly according to the invention absolutely laterally stable and to allow, nevertheless, certain tolerances in the construction of the piece of furniture. The resilient supporting rail is able to adapt itself within this relatively wide range of tolerances. The movable supporting rail in this arrangement is pulled to the drawer by the associated pull-out rail.

An embodiment of the invention provides that the pull-out rails and the supporting rails have limiting flanges at the free edges of their running flanges, such limiting flanges abutting the rollers, and each rail advantageously having one limiting flange only.

An advantageous embodiment of the invention provides that roller carriers are arranged between the supporting rails and the pull-out rails, the rollers being superjacently mounted on the roller carriers, and either the upper or lower of the rollers being laterally guided by the rails and their limiting flanges, while the other rollers have no lateral stops.

To improve the distribution of forces, it is further advantageously provided that the rollers which are laterally guided by the rails have the shapes of truncated cones at their opposite axial sides.

An embodiment of the invention provides that the pull-out rails which have upper and lower running flange have an angular flanges each portion at their central connecting flange adjacent to a running flange.

Mounting of the pull-out rails at the drawers is advantageously effected by fastening the pull-out rails to the drawer side walls by means of fastening screws which extend through the furniture side walls, rest with their heads against the inner surfaces of the drawer side walls and engage in female threads in or at the pull-out rails.

It is thus possible, when manufacturing or assembling the piece of furniture, to completely fasten each side of the pull-out guide assembly, i.e. supporting rail and pull-out rail, to the furniture side wall. Then the drawer is fitted onto the pull-out rails, and by means of the fastening screws the drawer is, on one side, rigidly connected to the stable side, i.e. to the fixed side, of the pull-out guide assembly, and on the other side, the pull-out rail can, together with the supporting rail which is held by such pull-out rail directly or indirectly by means of the rollers, be pulled against the drawer side wall.

When using rollers which are mounted in a separate roller carrier it has proved advantageous to arrange the rollers in the corners of a rectangle. Due to the fact that the rollers, between which the running flange and the supporting rail are received, are directly superjacently arranged, the running flange of the supporting rail is prevented from being unintentionally pulled out laterally between the rollers.

BRIEF DESCRIPTION OF THE DRAWINGS

Below an embodiment of the invention will be described in more detail with reference to the accompanying drawings, in which.

DESCRIPTION OF PREFERRED EMBODIMENT

Figure 1:
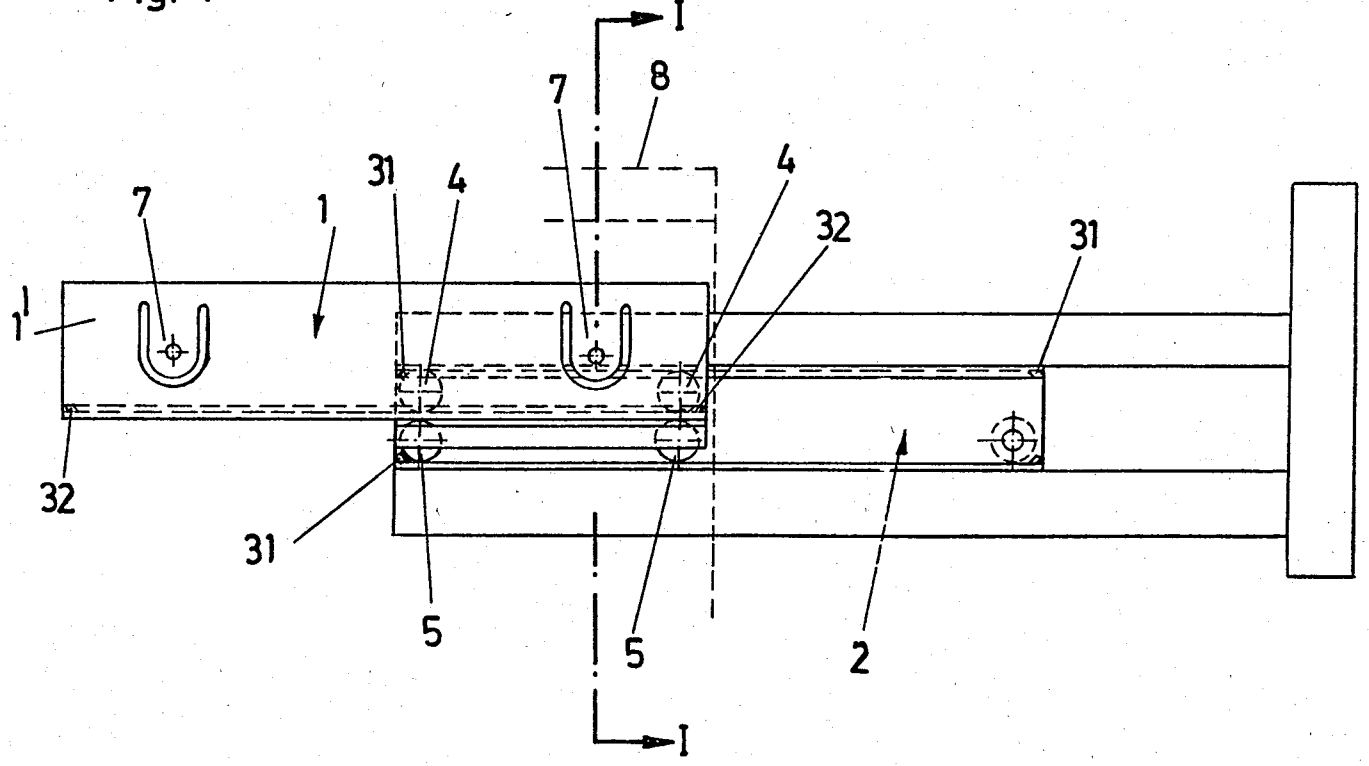
FIG. 1 is a schematic side view of a pull-out guide with the drawer in the extracted position.

FIG. 1 shows that side of a pull-out guide assembly at which a supporting rail 1, including its running flange 11, can be pulled away from a respective furniture side wall 6, due to the provision of at least one bendable flap 7 in rail 1. The supporting rail 1 on the other side of the drawer is analogously designed, except that no fastening flaps 7 are provided and that, hence, such supporting rail 1 is with its fastening flange 1' directly and rigidly fixed to the furniture side wall 6 by means of screws 8.

The pull-out rails 2 as well as the roller carriers 3 are designed in an analogous manner on both sides of the pull-out guide assembly.

Figure 2:
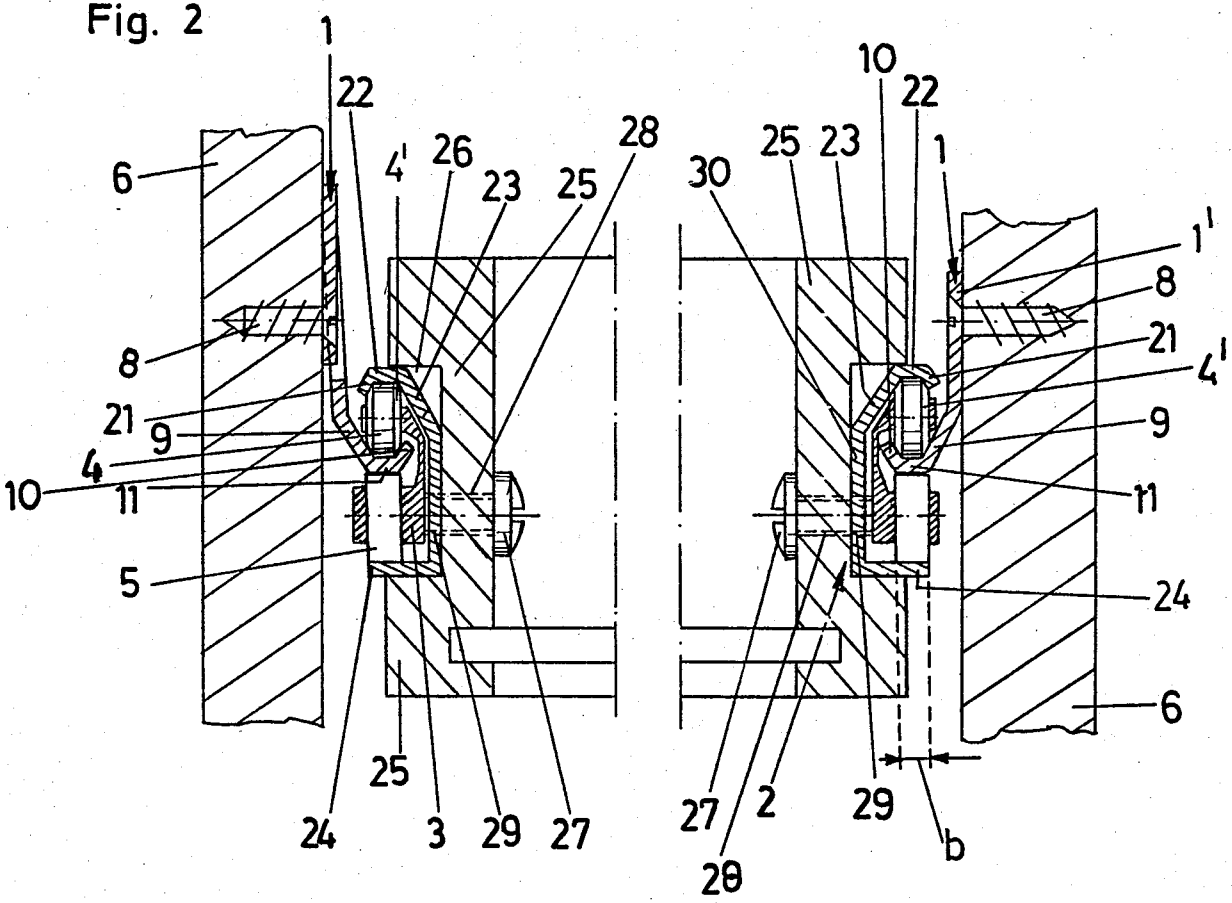
FIG. 2 is a sectional view along line I—I of FIG. 1.

As can be seen in FIG. 2, each supporting rail 1 has a lower V-shaped region defined by an angular portion 9 and a limiting flange 10 together with the running flange 11. The limiting flange 10 is included upwardly from flange 11.

Each pull-out rails 2 has a corresponding upper region which is also formed by a limiting flange 21, a running flange 22 and an angular portion 23. These regions of rails 1 and 2 receive therebetween upper rollers 4 of the roller carriers 3.

By means of the limiting flanges 10, 21 and the angular portions 9, 23, the rollers 4 are also laterally held between the supporting rails 1 and the pull-out rails 2. Lateral forces may be exerted by the supporting rails 1 via the rollers 4 on the pull-out rail 2, and vice versa.

As can also be seen in FIG. 2, opposite axial sides of the upper rollers 4 are shaped as truncated cones so that there are obtained inclined lateral running faces 4' that complementarily contact flanges 10, 21 and the angular portions 9, 23.

At their lower sides the pull-out rails 2 are provided with flanges 24 which are open from the respective drawer side walls 25.

The lower rollers 5 of the roller carriers 3 are cylindrical, and do not absorb lateral forces but serve exclusively for the transmission of vertical loads. The width b of all rollers 4, 5 is equal.

The pull-out rails 2 are located in grooves 26 in the drawer side walls 25.

Fastening screws 27 project through holes 28 in the drawer side walls 25 and engage in female threads 29 in the connecting flanges 30 of the pull-out rails 2. (Each connecting flange 30 connects the running flanges 22, 24 of the respective pull-out rail 2).

For mounting purposes, a supporting rail 1, a pull-out rail 2 and a roller carrier 3 form a unit. Two such units are fastened to respective furniture side walls 6 by means of the supporting rails 1 in a conventional manner, for example by means of screws 8.

Then the drawer is fitted onto the pull-out rails 2 and fastened by means of fastening screws 27. When the right side fastening screw 27 is fastened, the drawer is pulled (in the illustrated arrangement) toward the right pull-out rail 2, and, on the other side, the left pull-out rail 2 and the supporting rail 1 by means of the rollers are pulled to the drawer away from wall 6 and flaps 7. This pulling of the flange 1' of supporting rail 1 is possible because the flaps 7 only are fastened to wall 6.

In the illustrated embodiment, the pull-out rail 2 is provided tightened, then pull-out rail 2, carrier 3, and rollers 4, 5 and flange 1' of the supporting rail 1 portions of the respective running flanges 22, 24, and each supporting rail 1 has front and rear stops 32, thus preventing the parts of the pull-out guide assembly from being separated. Thus, it also is possible to prevent the drawer from being unintentionally fully pulled out from the furniture body and the supporting rails 1.

What is claimed is:

1. In a drawer guide assembly for mounting a drawer for sliding movement into and out of a furniture body, said assembly being of the type including, for each of opposite sides of the drawer, a unit comprising a supporting rail attachable to a respective side of the furniture body, a pull-out rail attachable to a respective side wall of the drawer, and plural rollers positioned between and rollingly contacting respective surfaces of said supporting and pull-out rails, such that the weight of the drawer is transmitted from the pull-out rails to the supporting rails by means of said rollers, the improvement comprising:

a first said supporting rail being of a rigid construction such that it may be rigidly fixed to the respective side of the furniture body;

a second said supporting rail being of a flexible construction such that a portion thereof may be laterally movable from the respective side of the furniture body after attachment thereto;

said supporting and pull-out rails of each said unit having gripping portions for laterally retaining therebetween the respective said rollers; and means for, after said supporting rails of said units have been attached to respective sides of the furniture body, joining said pull-out rails of said units to respective side walls of the drawer and for compensating for dimensional tolerances resulting from the spacing between said pull-out rails of said units being greater than the lateral dimension of the drawer, said joining means comprising first connecting means for connecting the respective drawer side wall to the first said pull-out rail adjacent said rigid first supporting rail and thereby for moving the drawer toward said first pull-out rail, said first connecting means comprising a first bolt extending through a hole in the respective drawer side wall and threaded into said first pull-out rail, said first bolt having a head abutting an inner surface of the respective drawer side wall, and second connecting means for connecting the respective drawer side wall to the second said pull-out rail adjacent said flexible second supporting rail and thereby for laterally moving said unit including said portion of said second supporting rail toward the respective drawer side wall, said second connecting means comprising a second bolt extending through a hole in the respective drawer side wall and threaded into said second pull-out rail, said second bolt having a head abutting an inner surface of the respective drawer side wall.

2. The improvement claimed in claim 1, wherein said surfaces of said supporting and pull-out rails are defined by respective horizontal running flanges thereof, and said gripping portions comprise limiting flanges extending from one side of each respective said running flange and abutting said rollers.

3. The improvement claimed in claim 2, wherein opposite axial ends of each said roller have truncated conical surfaces, and the respective said limiting flange is inclined from a first side of the respective said running flange and abuts one said conical surface.

4. The improvement claimed in claim 3, wherein said gripping portions further comprise angular portions inclined from second sides of the respective said running flanges and abutting opposite said conical surfaces of said rollers.

5. The improvement claimed in claim 1, wherein said rollers are supported by roller carriers, and further comprising additional rollers supported on said carriers and rollingly contacting additional surfaces of said supporting and pull-out rails, said additional rollers being free of lateral restraint from said rails.

6. The improvement claimed in claim 1, wherein said flexible construction of said second supporting rail is formed by punching out bendable flaps from said portion, such that when said flaps are attached to the respective side of the furniture wall, said portion is bendable therefrom.

* * * * *